US005092533A

United States Patent [19]

Gangemi

[11] Patent Number: 5,092,533

[45] Date of Patent: Mar. 3, 1992

[54] METHOD FOR EFFECTING A SET CHANGE IN A WINDER

[75] Inventor: Donald Gangemi, Great Barrington, Mass.

[73] Assignee: Beloit Corporation, Beloit, Wis.

[21] Appl. No.: 597,146

[22] Filed: Oct. 15, 1990

[51] Int. Cl.[5] ..... B65H 19/26; B65H 19/28; B65H 19/29

[52] U.S. Cl. ..... 242/56.8; 242/56 R; 242/66

[58] Field of Search ..... 242/56 R, 56.6, 56.8, 242/66

[56] References Cited

U.S. PATENT DOCUMENTS

| | | | |
|---|---|---|---|
| 3,918,654 | 11/1975 | Okubu et al. | 242/56 R |
| 4,327,877 | 5/1982 | Perini | 242/66 |
| 4,345,722 | 8/1982 | Kuhn | 242/56 R |
| 4,368,855 | 1/1983 | Schönmeier et al. | 242/56 R |
| 4,370,193 | 1/1983 | Knauthe | 242/56 R X |
| 4,408,727 | 10/1983 | Dropczynski | 242/56 R |
| 4,422,588 | 12/1983 | Nowisch | 242/56 R X |
| 4,485,979 | 12/1984 | Dropczynski | 242/56 R |
| 5,030,311 | 7/1991 | Michal et al. | 242/56 R X |
| 5,031,850 | 7/1991 | Biagiotti | 242/56 R X |

*Primary Examiner*—John M. Jillions

*Attorney, Agent, or Firm*—Dirk J. Veneman; Raymond W. Campbell; Gerald A. Mathews

[57] ABSTRACT

A method for effecting a set change in a winder for a papermaking machine, comprises skip-slitting the paper web across the width of the web transversely to the direction of web travel in the winder. An adhesive stripe is applied to the web on either side of where the skip-slit is located. The skip-slit and application of the glue is done at a location upstream of the winder to avoid the problems associated with mounting and operating such equipment beneath the winder. The paper web is severed by advancing the skip-slit to a position near the 10 o'clock position over the surface of a first winder drum where the web is halted and the wound paper roll is urged off its support on the first winder drum to thereby increase the tension in the web between the wound roll and web supported on the first winder drum to sever the web. The adhesive stripes on either side of the severance are then applied to the wound roll and a new core, and the process is repeated.

14 Claims, 3 Drawing Sheets

METHOD FOR EFFECTING A SET CHANGE IN A WINDER

BACKGROUND OF THE INVENTION

1. Field of the Invention

This invention relates to winders used in the papermaking industry for the continuous production of successively wound rolls of paper. More particularly, this invention relates to a method for cross-cutting the paper web utilizing a skip-slitting laser, applying an adhesive to the trailing and leading edges of the cross-cut paper web, and applying the trailing edge to the previously wound roll and the leading edge to a new core. Still more particularly, this invention relates to the method of effecting a set change in a winder wherein the web cross-cutting apparatus, the adhesive application apparatus and the adhesive activation apparatus are located upstream of the first winder drum, and the web severance is after the skip-slitting operation.

2. Description of the Prior Art

In prior winders in the papermaking field, the various functions of severing the web in the cross-machine direction, adhering the trailing edge of the severed paper web to the previously wound roll, and adhering the leading edge of the severed web to a new core, or reel spool, have not been especially well coordinated. Equipment is known, for example, for urging the previously wound roll of paper off of its support on a two-drum winder while coordinating paper web. Finally, various mechanical means are known for severing the paper web while the web is either supported on one of the winder drums or is stretched in a taut span above a horizontal plane through the axes of a two-drum winder.

However, while the individual functions of severing the web in the cross-machine direction, introducing a new core into an initial position relative to the winder drums, and applying glue to the trailing and leading edges of the severed web are known in the art, all of these important aspects of a winder set change have not heretofore been coordinated in a winder which does not require one or more of these functions be done by apparatus mounted between and/or below the winder drums. Thus, in prior apparatus for cross-cutting the web in a two-drum winder, such as shown and described in U.S. Pat. No. 4,368,855 (Schonmeier et. al.), a cross-cutting knife must pass upwardly between the two winder drums to sever the web while the web is held against the surface of one winder drum. In Okubo et.al., U.S. Pat. No. 3,918,654, apparatus is shown and described which urges a wound roll of paper out of the winder while simultaneously inserting a new core, but the web is also severed by a knife moving upwardly from beneath the two support drums. Adhesive is applied to two spaced regions on the web supported on the top of one of the winder drums which requires that the previously wound roll be removed before the adhesive is applied.

In Dropczynski, U.S. Pat. No. 4,485,979, a pivoted apparatus is utilized for ejecting the previously wound roll, severing the web and attaching the severed web onto a new core. All of this activity takes place by apparatus which must pivot about a winder drum and mechanically sever the web and attach the leading edge onto a non-rotating core.

Thus, in the prior art, all of the elements of a winder set change were either not provided in the same apparatus, or the apparatus was cumbersome to the extent that it required equipment to be located beneath the winder drums, where it could not be serviced easily, or it was attached to pivoted arms which were also used to move a wound roll out of the winder, or to insert a new core, or both. This also is cumbersome in that it requires all of the equipment to be shut down when only one of the component parts providing a specific function needs to be serviced.

SUMMARY OF THE INVENTION

The operating deficiencies and inefficiencies of prior winders, particularly two-drum winders, have been obviated by this invention. In this invention, the cross-cutting, but not complete severance, of the paper web, the application of the adhesive, and the application of the adhesive is provided by separate apparatus, each component of which is positioned upstream of the first winder drum where it can be easily serviced and replaced, if necessary, without disrupting the other components needed to effect a set change, which is the removal of a wound roll and the initiation of winding of the web onto a new core. In addition, this invention utilizes the operation of the winder drums individually and in conjunction with the position and removal of the previously wound roll to effect the actual severance of the web.

This method of effecting the set change preferably utilizes a laser which is directed to cut the paper web in a longitudinally extending series of discrete slits which are spaced from one another across the web to a perforate the web. In other words, the laser is rapidly pulsed on and off while its directed beam is transversely traversing the paper web so as to produce a series of aligned holes or slits in the web with non- perforated or non-slit portions of the web between the cut portions. Two, parallel, co-extending stripes of adhesive are sprayed onto the web with the perforations/slits aligned between the stripes of adhesive. The adhesive used preferably is of the type which is relatively inert so as to have little or no properties of adherence until activated by a source of energy, such as ultraviolet light, infrared light, or microwave energy, which renders the adhesive active upon being exposed to the source of energy. However, it is contemplated to use other adhesives which are active to bond paper to paper and paper to a new core inherently without having to be activated by energy from an energy producing device.

By perforating, or skip-slitting, the web, the continuous traveling web retains its continuous form and integrity, and some of its machine direction strength, while permitting adhesive to be applied to the trailing edge of the unsevered portion of the web which will later be wound onto the preceding wound roll of paper, and to the leading edge of the unsevered portion of the web which will be wound onto a new core. Since the web retains its structural integrity, it can be passed around a rotating winder drum and stopped over any portion of the drum periphery without requiring support of the portions on either side of the skip-slit or perforations Further, such passage around the winder drum and change of direction can be effected without the adhesive contacting any surface to which it is not intended to contact and ultimately adhere to. Finally, the eventual severance of the web into a trailing portion which is adhered to a wound roll of paper, and a leading portion which is wound onto a new core, is effected by creating a tension in the web at a desired time when the perforations are in a span between the first winder drum and the previously wound roll of paper. At the time of web severance, the adhesive stripe on the leading edge of the web is positioned to adhere it to a new core.

None of the equipment needs to be mounted beneath the winder drums, and no knives needing sharpening or periodic replacement are utilized.

Accordingly, it is an object of this invention to provide a method for effecting an efficient set change in a papermaking machine winder Another object of this invention is to provide a method for severing a traveling paper web, including the use of means, such as a laser, for skip-slitting the web, and adhering the trailing edge of the severed portion of the web to the wound paper roll, and adhering the leading edge of the portion of the severed web onto a new core.

A feature and advantage of this invention is that a winder set change is efficiently accomplished without the need for adhesive and cross-cutting apparatus beneath the winder drums.

An object, feature and advantage of this invention is the provision of apparatus for effecting the winder set change, including the determination of the location of the eventual web severance, at a point upstream of the first winder drum.

These, and other objects, features and advantages of this invention will become readily apparent to those skilled in the art when the following description of the preferred embodiment is read in conjunction with the attached figures.

DESCRIPTION OF THE PREFERRED EMBODIMENT

In this description, with reference to the various figures, corresponding elements in the different views will be correspondingly numbered with different letter postscripts to distinguish between the corresponding elements. Similarly, corresponding elements in the same view, or in a related series of views, will be correspondingly numbered with different prime superscripts to distinguish them.

Figure 1:
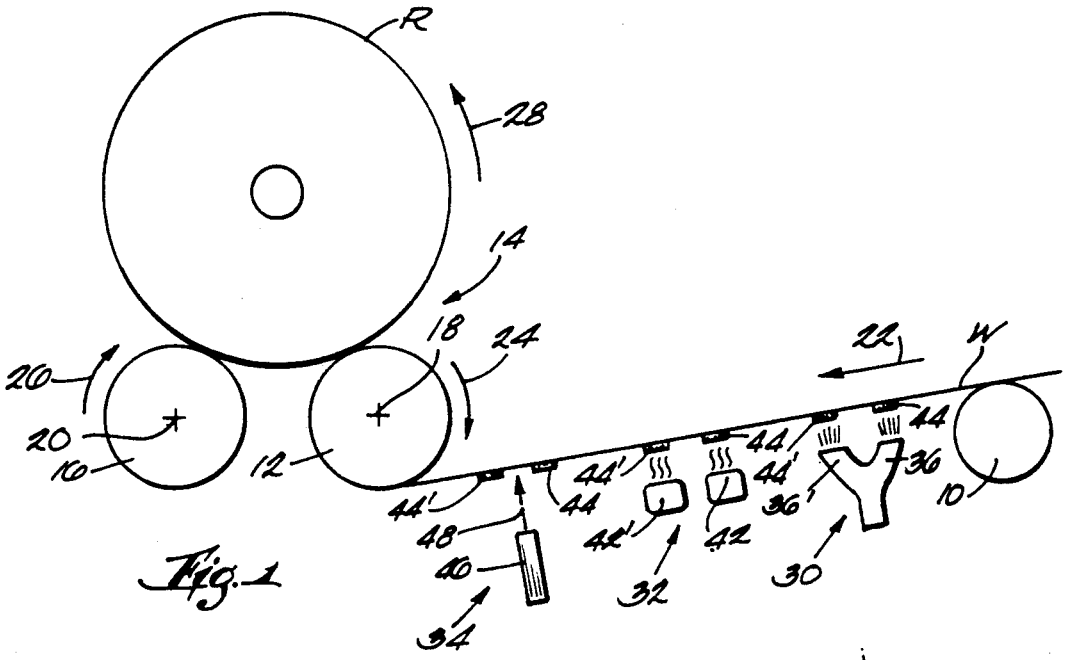
FIG. 1 is a side-elevational view, in schematic form, of a two-drum winder and showing the adhesive applicator, adhesive activator, and laser cutter positioned upstream of the first drum.
Figure 1A:
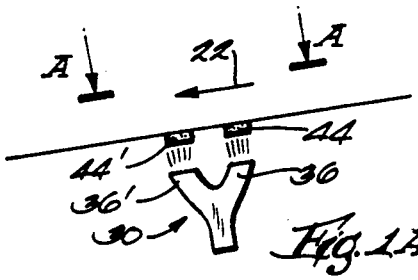
FIGS. 1A, 1B and 1C illustrate the sequence of applying parallel stripes of adhesive, activating the adhesive to a state where it will adhere to a paper web, and skip-slitting the web respectively

As shown in FIG. 1, a traveling paper web W is shown passing over the last slitter roll 10 and passing onto and around the first drum 12 of a two-drum winder 14 having a second support drum 16 wherein the axes 18,20 of the two support drums are in a substantially horizontal plane. A roll of paper R is shown being supported on the two winder drums as it is being wound to a desired diameter with the on-coming paper web. The web, winder drums and wound roll travel in the direction of arrows 22,24,26,28, as shown.

Figure 1D:
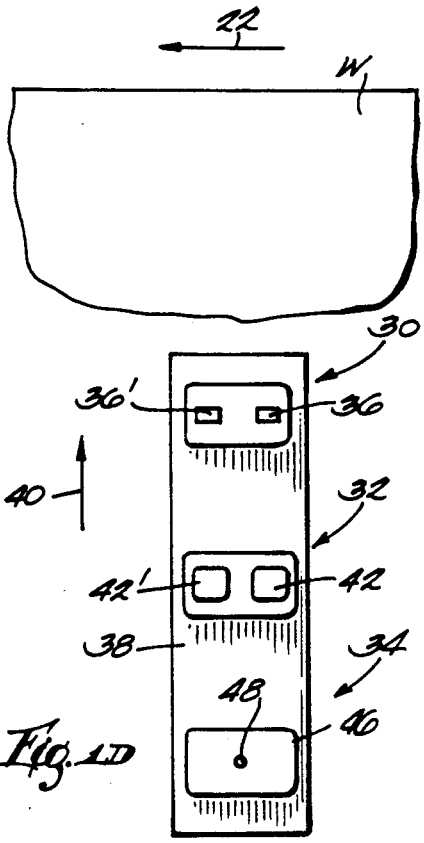
FIG. 1D is a plan view along the lines "A"-"A" in FIGS. 1A, 1B, 1C of the traversing carriage on which is mounted the apparatus for applying the adhesive, activating the adhesive, and skip-slitting the web in the sequence shown in FIGS. 1A, 1B and 1C.
Figure 1B:
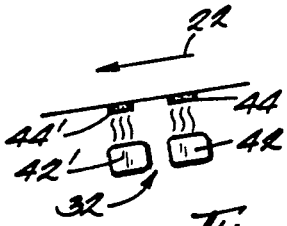
Figure 1C:
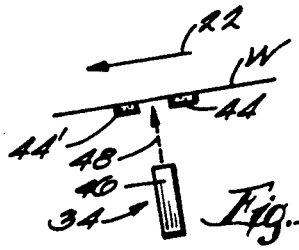

Also shown in FIG. 1, positioned beneath the traveling web upstream of the first winder drum 12, is the adhesive applicator 30, the adhesive activator 32 and the laser slitter 34. With reference to FIGS. 1A, 1B, 1C and 1D, the preferred order of these devices, in the direction of web travel 22, are the adhesive applicator 30, comprising two, laterally spaced spray nozzles 36,36′ which are spaced in the direction of web travel 22. The applicator 30, activator 32 and laser apparatus 34 are mounted on a carriage 38, as shown in FIG. 1D, which is positioned beneath the traveling web in FIG. 1 and is adapted by means (not shown) to traverse the web perpendicular to the direction 22 of web travel. Thus, the depictions of the applicator, activator and laser apparatus shown n FIGS. 1, 1A, 1B and 1C are representations for purposes of illustration only to show the sequence of the corresponding steps; these actual devices can be in different forms which are aligned in tandem on carriage 38 to traverse the web in traversing direction 40 shown in FIGS. 1D and 7. In fact, in the preferred embodiment, laser apparatus 34 on carriage 38 actually takes the form of a mirror for directing the laser beam against the paper web. Since the laser itself is relatively large and cumbersome, it is mounted outside the winder and its laser beam is directed against the web by a series of turning mirrors, the last one of which is mounted on the carriage The laser and mirrors, per se, do not form part of the invention, so they will not be described in further detail. Further, it is also contemplated that other means, such as a water jet, or a reciprocity knife, could be mounted on the carriage to be intermittently actuated to produce the skip-slits transversely across the web.

Figure 7:
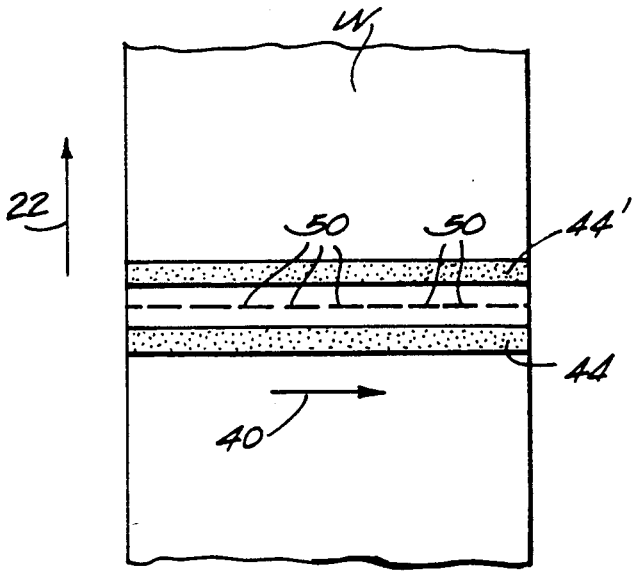
FIG. 7 is a plan view of the paper web showing the skip-slit cuts formed in the web by the laser and flanked by parallel stripes of adhesive.

Accordingly, downstream of the adhesive applicator is the adhesive activator apparatus which comprises one or more energy producing devices 42,42′ which direct energy, such as ultraviolet light, infrared light or microwaves, against the strips adhesive 44,44' to activate the adhesive to a state, or condition, where it will adhere two pieces of the paper web together or adhere the web onto a core. Downstream of the energy producing devices 42,42' is a laser 46 which is arrayed to direct a laser beam 48 against the taut span of the web W between the first winder drum 12 and the slitter roll 10 to produce a series of aligned cuts 50 transversely of the paper web as shown in FIG. 7. Such aligned cuts can take the form of either a series of closely spaced holes, or they can take the form of a series of spaced, end-aligned slits having a length which is predetermined. The function of the laser is to produce cuts in the traveling web which will enable the web to be severed along a path defined by the perforations/slits produced by the laser upon tensioning the web above a predetermined tension force, but retaining enough uncut span of the web to provide it with sufficient structural integrity to permit the web to travel in its guided path around the first winder drum and onto the roll of paper being wound under normal operating conditions, including normal operating tension in the traveling web.

Figure 6:
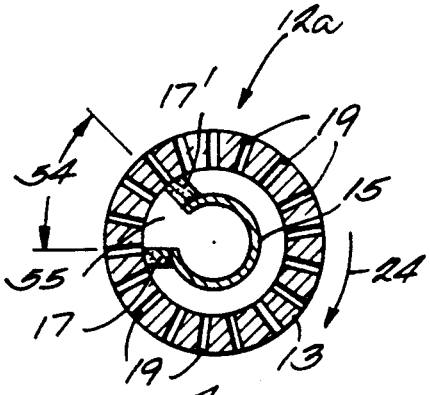
FIG. 6 is a cross-sectional end view, in schematic form, of one embodiment of the first drum on a two-drum winder.

As shown in FIG. 6, the first drum on the winder can comprise a plain surfaced cylinder, or it can comprise a so-called suction roll **12*a* having a perforated roll shell 13, a hollow center support beam 15 and a pair of longitudinally extending seals 17,17' which define an arcuate segment beneath the roll surface. A source of vacuum, not shown, applied to the interior of beam 15 produces sub-atmospheric air pressure through perforations 19** to the roll surface to urge the paper web wrapping the roll between the seals to remain against the roll.

In operation, with reference to FIGS. 1, 1A, 1B, 1C and 7, a roll R is being wound on the support winder drums 12,16. When the wound roll reaches the desired diameter, the web W is briefly halted, and the carriage 38 containing the adhesive applicator 30, the adhesive activator 32 (if required due to the type of adhesive used) and the slitter 34 arranged in tandem is passed beneath the web to produce the skip-slits 50 extending transversely across the web and flanked by two parallel stripes of adhesive which have been activated. In other words, two stripes 44,44' are applied to the web by spray nozzles 36,36'. Immediately, the two stripes are activated by energy devices 42,42'. Then, the laser beam 48 cuts the skip-slits 50 in the web between the activated adhesive stripes. The web is restarted and travels with the activated glue stripes on the side of the web opposite the side of the web engaging the surface of the first winder drum 12.

Figure 2:
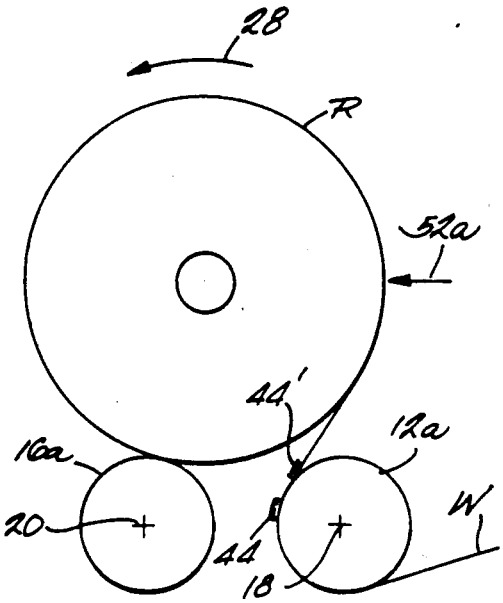
FIG. 2 is a side-elevational view, in schematic form, of a two-drum winder showing the web being severed under tension at the skip-slit location as the wound roll rotates over the second winder drum.
Figure 4:
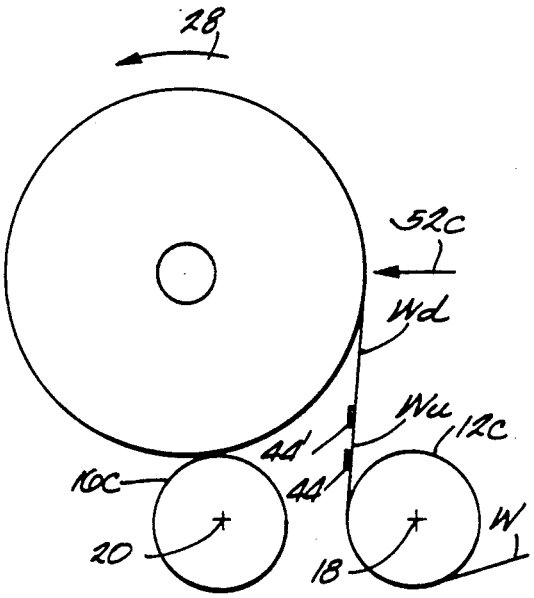
FIG. 4 is a side-elevational view of a two-drum winder, in schematic form, showing the web being severed at the skip-slit location by creating tension in the web as the wound roll rotates over the second drum of the winder while the upstream portion wraps the first drum.
Figure 3:
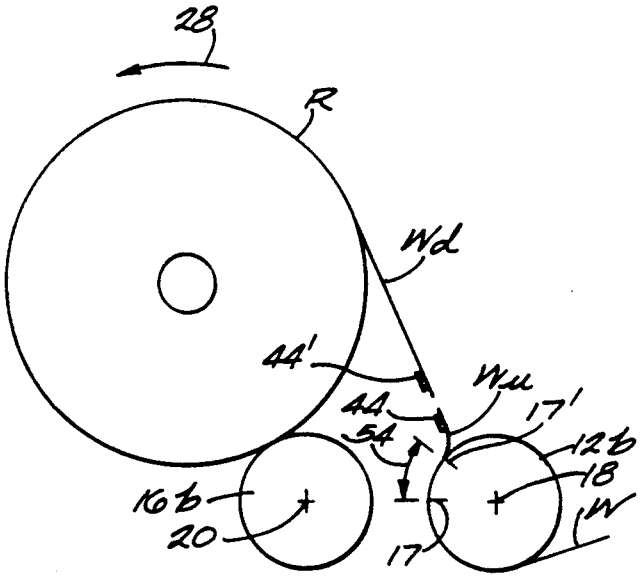
FIG. 3 is a side-elevational view, in schematic form, of a two-drum winder showing the web being severed under tension at the skip-slit location with the upstream portion being held against the front drum of the winder by vacuum pressure.

When the slits 50 and parallel glue stripes 44,44' have reached the position shown in FIGS. 2, 3 or 4, with the trailing glue stripe 44 in approximately the 10 o'clock position over the surface of the first winder drum 12, the web is halted and severed in one of several, generally related operations.

The web is severed by applying tension force to it sufficient to cause the web to tear between the slits 50 cut into it by the laser. This tension is produced by applying a force, shown schematically in FIGS. 2 and 4 by arrow 52, to cause the wound roll R to rotate about its radius over the surface of the second drum **16*c* while the upstream portion of the web is held over the surface of a plain surfaced first drum 12*c* (FIG. 4), or the web is held against the perforated surface of a first drum 12*b* (FIG. 3) by a vacuum pressure force produced beneath the web against a portion of the drum surface subtended by an arc 54 over a suction gland 55 connected to a source of vacuum (not shown), which is shown in detail in FIG. 6 and schematically by the vacuum chamber end seals 17,17' in FIG. 3**.

The force 52 preferably takes one of two preferred forms. In the first, a rotatable roller having a longitudinal axis parallel with the longitudinal axis of roll R being wound engages the surface of roll R. The roller permits roll R to rotate without rubbing the surface to damage the paper. In the second, a pair of arms support a sliding plate, or plates, which are mounted in conjunction with a core holder. When the arms, which can be pivoted, move the plate(s) against the surface of roll R, the plate slides along a tangent to the roll at its line of contact therewith and in the direction of roll rotation. This permits the force 52 to be applied to move, or rotate, roll R without relative movement between the sliding plate and the surface of roll R, which also prevents damage to the paper on the surface of roll R. Thus, both the rotatable roller and sliding plate types of roll ejector 52 prevent relative movement between the ejector and wound roll as it rotates out of the winder.

The configuration shown in FIG. 2 is substantially generic to the configurations shown in FIGS. 3 and 4. In the case where the web W comprises a somewhat heavy sheet, such as kraft paper or liner board, the tension provided would preferably take the form shown in FIG. 4 where the structure of the first winder drum **12*c*** provides the resistance to the tension in the downstream portion $W_d$ of the web W.

In the case where the web is lightweight, such as tissue, the vacuum pressure provided by the vacuum gland 55 defined by seals 17,17' within the perforated first drum **12*b* could be sufficient to hold the upstream portion $W_u$ of the web onto the surface of the first drum as the web is severed along skip-slits 50** under the tension provided by the wound roll being removed.

Figure 5:
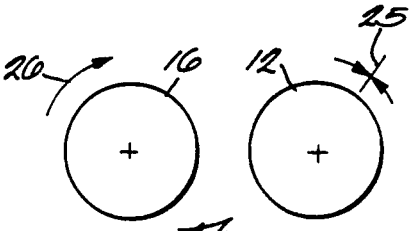
FIGS. 5, 5A and 5B are end views, in schematic form, of the two support drums in a two-drum winder and showing combinations of first and second winder drum speed to create severing tension in the web.
Figure 5A:
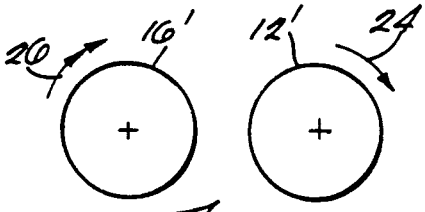
Figure 5B:
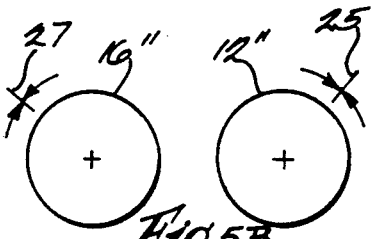

The removal of the wound roll is initiated by the application of a lateral force **52*a* to the side of the wound roll, but the tension in the downstream portion of the web wrapped around the wound roll can be controlled, and the speed of the wound roll removal and web severance increased by controlling the relative movement between the second and first winder drums 12*a*,12*b*. Thus, as shown in FIG. 5, the winder drums shown in FIGS. 1-4 can be operated in different combinations of rotation or being stopped as shown in FIGS. 5, 5A and 5B. Specifically, with reference to FIG. 5, the first winder drum 12 can be stopped as indicated by symbol 25 and the second winder drum 16 rotated in the direction of arrow 26. Referring to the situation in FIG. 2, for example, when the force 52*a* urging the wound roll from being supported below by both winder drums to be supported below solely on the second winder drum 16*a*, and laterally by the roller or sliding plate of force 52** which lifts the roll over the second winder drum, the rotation of the second winder drum, with or without continued traveling motion of the wound roll over the surface of the second winder drum, produces increased tension in the web which severs the web into a downstream portion $W_d$ and an upstream portion $W_u$.

In FIG. 5A, the web severing tension is produced by rotating the first drum 12' relatively slowly in the direction of arrow 24, and the second drum 16' is rotated relatively faster in the direction of arrow 26. The speed differential between the two winder drums produces tension in the web sufficient to sever it along the slits 50 previously cut into the web by the laser.

As shown in FIG. 5B, both the first and second winder drums can be stopped 25,27 and the web severed by the increased tension produced as the wound roll R is pushed over the surface of the second drum 16" which increases the distance between the tangent point of the downstream portion of the web on the wound roll and the upstream portion of the web held against the surface of the first drum. This is the preferred configuration for producing the web severing tension.

Figure 8:
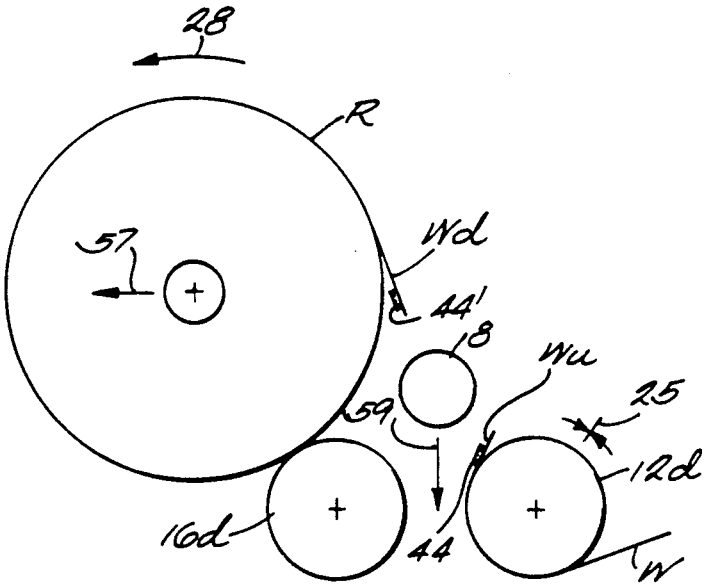
FIGS. 8 and 8A are side-elevational views, in schematic form, of a two-drum winder showing a new core being inserted into position between the drums as the wound roll of paper is removed (FIG. 8), and the winding operation commencing (FIG. 8A).
Figure 8A:
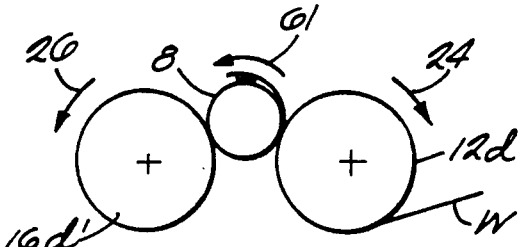

With reference to FIGS. 8 and 8A, when the web has been severed and the previously wound roll moving away from the winder in the direction of arrow 57, the activated adhesive stripe 44' on the end of the downstream portion $W_d$ of the web will bond the trailing edge of the web to the wound roll. In the case where the ejector (force 52) includes a rotatable roller or a sliding plate, the bonding of the trailing edge to the wound roll will be done when the trailing edge passes through the nip between the roll and the roller or plate. The upstream stripe 44 of activated glue on the leading end of the upstream portion $W_u$ of the web will be approximately in the 10 o'clock position over the first winder drum surface. A new core, or reel spool, 8 will be positioned in the winder and moved downwardly in the direction of arrow 59 to contact the upstream activated adhesive stripe 44 and winding will commence on the new core as it rotates on drums 12*d*',16*d*' in the direction 61 as shown in FIG. 8A. The location of the upstream end of the web over the surface of the first winder drum will vary somewhat according to operating conditions, and the upstream portion will be positioned according to whether the web is held against the drum surface by vacuum pressure, or its inherent stiffness, or some combination of both. It is also contemplated that, if necessary, due to some unusual combination of web stiffness and operating conditions related to the timing of the new core insertion, some external means, such as an arm pivoting about either drum, could be used to assist in maintaining the upstream portion $W_u$ of the web in position over the first drum as the new core is being inserted To recapitulate the method, in view of the continuous nature of the operation, either a roll of paper web is being wound while supported on the two drums, or a new core is inserted onto the adhesive stripe at the end of the web, which is stopped with the adhesive stripe located at approximately the 10 o'clock position over the surface of the first winder drum. In either case, winding of the wound paper roll continues until the wound roll approaches a predetermined diameter.

At this point, within a wrap or two of the desired wound roll diameter, the on-coming paper web is briefly stopped. Carriage 38 is activated to traverse the web. Spray nozzles 36 of adhesive applicator 30 apply two, parallel stripes 44,44' of adhesive across the web. Immediately behind applicator 30, and aligned over stripes 44,44', are activators 32,32' which direct energy against the stripes to change them from an essentially inert state to an active state such that it will bond the web to the paper on the wound roll or to a new core. Although this is the preferred type of adhesive, it is contemplated that an adhesive which does not require an energy device to activate it could be used so long as it is effective on paper and cores. Laser 46, which is downstream of the adhesive applicator and adhesive activator, alternately pulses its beam 48 on and off as the carriage moves to produce a series of end-aligned cuts, or skip-slits 50, across the web between the adhesive stripes.

The web is thus partially cut but retains enough structural integrity to enable it to follow a defined path over the first drum and toward the periphery of the roll being wound. The winder is started to move the skip-slit and stripes downstream and partially over the first drum.

When the adhesive stripes have been advanced to approximately the 10 o'clock position over the first drum 12, the web is again halted, and it is severed along the skip-slits/perforations by increasing the tension in the web by urging the wound roll off its support on the first and second drums in combination with the relative speed/stoppage of the first and second drums as depicted in FIGS. 5, 5A and 5B and described above.

The downstream stripe of adhesive on the severed downstream end of the web is attached to the wound paper roll as it is rolled off the winder. The upstream stripe remains over the first winder drum in approximately the 10 o'clock position where it is engaged by a new core as it is lowered into position in the notch between the winder drums.

The set change has been completed, and the winder is again started with a new core being wound into a new roll by the rotating drums.

Depending on whether the first dryer drum is a plain surfaced roll, or whether it comprises a vacuum roll having a perforated drum, and further reflecting the anticipated speed of the set change to be effected and the type of paper being wound, several combinations of relative rotational speed, including completely halting their rotation, can be made in the relative rotational speeds of the first and second winder drums. In all cases, the speed of the second winder drum moves no slower than the same speed of the first winder drum such that pivotal motion of the wound roll over the surface of the second winder drum produces increased tension in the web to cause it to sever along the skip-slit cuts between the activated stripes of adhesive previously applied on the web.

Upon severance of the web, the downstream edge of the web continues to rotate with the wound roll and eventually becomes bonded thereto either under the force of its own weight or upon passing through the nip between the wound roll and the second winder drum or a subsequent support member on its way to further processing.

The end of the upstream portion of the paper web remains supported over the first winder drum with the upstream stripe of adhesive located at approximately the 10 o'clock position on the first winder drum due to its residual stiffness or drape upon being severed in that position, or due to its being held against the surface of the first winder drum by the sub-atmospheric pressure induced within the drum beneath the perforated surface at that position, or due to some externally applied means, such as an arm moved about the drum.

Accordingly, it is seen that a new method for effecting the set change in a winder has been shown and described which achieves the objects and exhibits the features and advantages set forth. Naturally, variations in the invention can be made without departing from the spirit and scope of the appended claims which alone define and limit the invention.

What is claimed is:

1. A method for effecting the set change in a winder for producing successive rolls of wound paper, each onto a core, from a continuous traveling paper web, the winder including at least a first wound roll support drum, comprising the steps:

(1) halting the traveling continuous web from advancing to be wound into a paper roll;

(2) applying two, parallel stripes of adhesive to the web transversely to its direction of travel;

(3) skip-slitting the web between the stripes of adhesive;

(4) advancing the skip-slit in the web to a predetermined position over the periphery of the first drum;

(5) tensioning the web between the first drum and the roll being wound to thereby sever the web along the skip-slit;

(6) adhering the adhesive stripe downstream of the skip-slit to the wound paper web roll;

(7) receiving a core onto the adhesive stripe upstream of the skip-slit for attachment of the web onto the core;

(8) restarting the winder to wind the paper web into a wound roll on the new core.

2. A method for effecting the set change in a winder, as set forth in claim 1, wherein:

the application of the parallel stripes of adhesive to the web is upstream of the first winder drum.

3. A method for effecting the set change in a winder, as set forth in claim 1, wherein:

the skip-slit in the web is made upstream of the first drum.

4. A method for effecting the set change in a winder, as set forth in claim 1, wherein:

the first drum includes a vacuum gland for communicating a source of sub-atmospheric air pressure to a corresponding arcuate segment of the surface of the first drum at approximately the 10 o'clock position on the first drum; and further including the step of holding the portion of the web upstream of the skip-slit against the surface of the first drum over the vacuum gland as the web is being tensioned.

5. A method for effecting the set change in a winder, as set forth in claim 1, further including the steps of:

maintaining the web against downstream travel relative to the first drum;

urging the wound roll from being supported by the first drum while tensioning the web.

6. A method for effecting the set change in a winder, as set forth in claim 1, wherein:

the tensioning is produced by moving the wound roll out of the winder while holding the web from traveling movement relative to the first drum.

7. A method for effecting the set change in a winder, as set forth in claim 1, the winder further including a second wound roll support drum, further including the steps:

urging the wound roll from supporting engagement by the first drum and into supporting engagement by the second drum;

halting rotation of the first drum and downstream travel of the web;

rotating the second drum to thereby rotate the wound roll to increase the tension in the web to sever the web along the skip-slit.

8. A method for effecting the set change in a winder, as set forth in claim 1, the winder further including a second wound roll support drum, and further including the steps:

urging the wound roll from supporting engagement by the first drum and into supporting engagement by the second drum;

rotating the first and second drums with the second drum being rotated faster than the first drum whereby the tension in the web is increased to sever the web along the skip-slit.

9. A method for effecting the set change in a winder, as set forth in claim 1, the winder further including a second wound roll support drum, and further including the steps:

urging the wound roll from its support by the first drum and into support by the second drum;

halting rotation of the first and second drums;

moving the wound roll over the surface of the second drum away from the first drum to thereby increase the tension in the web to sever the web along the skip-slit.

10. A method for effecting the set change in a winder, as set forth in claim 1, wherein:

the skip-slitting of the web is done by a laser;

the application of the parallel stripes of adhesive and the skip-slitting of the web is done substantially simultaneously at a location upstream of the first support drum.

11. A method for effecting the set change in a winder for producing successive rolls of wound paper, each onto a core, from a continuous traveling paper web, the winder including first and second drums for rotatably supporting the wound paper roll, and means for supporting the paper web in a span upstream of the first drum, comprising the steps:

(1) halting the traveling continuous web from advancing to be wound into a paper roll;

(2) applying two, parallel stripes of adhesive to the web transversely to its direction of travel beneath the web in the span upstream of the first drum;

(3) skip-slitting the web between the stripes of adhesive in the span of the paper web upstream of the first drum;

(4) advancing the skip-slit in the web to a predetermined position over the periphery of the first drum;

(5) urging the roll being wound from supporting engagement by the first drum while maintaining its supporting engagement by the second drum;

(6) tensioning the web between the first drum and the roll being wound to thereby sever the web along the skip-slit;

(7) removing the wound roll from the winder;

(8) receiving a core onto the adhesive stripe upstream of the skip-slit for attachment of the web onto the core;

(9) restarting the winder to wind the paper web into a wound roll on the new core.

12. A method for effecting the set change in a winder, as set forth in claim 1, wherein:

the tensioning of the web and the removal of the wound roll is facilitated by maintaining the first drum halted while rotating the second drum.

13. A method for effecting the set change in a winder, as set forth in claim 11, further including the step:

adhering the adhesive stripe downstream of the skip-slit to the wound roll after the web is severed.

14. A method for effecting the set change in a winder, as set forth in claim 11, wherein:

the adhesive is relatively inert in a substantially non-adhesive state when applied; and further including the step exposing the adhesive stripes to activation energy to thereby activate the adhesive to a condition where it will bond paper to paper, or paper to a core.

* * * * *

UNITED STATES PATENT AND TRADEMARK OFFICE

CERTIFICATE OF CORRECTION

PATENT NO. : 5,092,533

DATED : March 3, 1992

INVENTOR(S) : Donald Gangemi

It is certified that error appears in the above—identified patent and that said Letters Patent is hereby corrected as shown below:

| | |
|---|---|
| Column 1, Line 30: | After "coordinating", please insert --the insertion of a new core into the notch between the winder drums. Also known is apparatus for applying glue to the trailing or leading edges of the previously severed--. |
| Column 4, Line 47: | Please delete "n" and insert --in-- in place thereof. |
| Column 5, Line 2: | Please delete "strips" and insert --stripes of-- in place thereof. |

Signed and Sealed this

Twenty-ninth Day of June, 1993

*Attest:*

*Attesting Officer*

Michael K. Kirk

MICHAEL K. KIRK

*Acting Commissioner of Patents and Trademarks*